US007834531B2

(12) United States Patent
Garcia

(10) Patent No.: US 7,834,531 B2
(45) Date of Patent: Nov. 16, 2010

(54) LAMP WITH RADIAL ARM ELECTRICAL CONTACTS

(75) Inventor: Ceferino Garcia, Juarez (MX)

(73) Assignee: OSRAM SYLVANIA Inc., Danvers, MA (US)

( * ) Notice: Subject to any disclaimer, the term of this patent is extended or adjusted under 35 U.S.C. 154(b) by 346 days.

(21) Appl. No.: 11/583,443

(22) Filed: Oct. 19, 2006

(65) Prior Publication Data

US 2008/0136308 A1 Jun. 12, 2008

(51) Int. Cl.
*H01J 5/50* (2006.01)

(52) U.S. Cl. ..... 313/318.03; 313/318.07; 313/318.12; 439/232

(58) Field of Classification Search ..... 313/318.01, 313/49–51, 634, 318.03, 318.07, 318.12, 313/318.09, 318.1; 439/232, 233, 239, 240
See application file for complete search history.

(56) References Cited

U.S. PATENT DOCUMENTS

| | | | | | |
|---|---|---|---|---|---|
| 3,859,554 | A | * | 1/1975 | Preziosi et al. | 313/318.01 |
| 4,193,653 | A | * | 3/1980 | Aizawa | 439/57 |
| 5,061,189 | A | * | 10/1991 | Iio et al. | 439/57 |
| 5,209,668 | A | * | 5/1993 | Higano et al. | 439/57 |
| 5,800,183 | A | * | 9/1998 | Paul et al. | 439/56 |

* cited by examiner

*Primary Examiner*—Nimeshkumar D Patel
*Assistant Examiner*—Christopher M Raabe
(74) *Attorney, Agent, or Firm*—Edward S. Podszus

(57) ABSTRACT

A lamp may be formed with radial arm electrical contacts from a ceramic body insulating body supporting a lamp capsule. A press sealed tubular lamp is held in an end of the ceramic body. The radial arms extend sideways from the ceramic body and support electrical contacts, that may be brought into electrical contact in an insert and twist type socket.

23 Claims, 2 Drawing Sheets

LAMP WITH RADIAL ARM ELECTRICAL CONTACTS

CROSS-REFERENCE TO RELATED APPLICATIONS

Not Applicable

BACKGROUND OF THE INVENTION

1. Field of the Invention

The invention relates to electric lamps and particularly to ceramic bases. More particularly the invention is concerned with high temperature electric lamps with ceramic bases.

2. Description of the Related Art Including Information Disclosed Under 37 CFR 1.97 and 1.98

High temperature and high wattage electric lamps with ceramic bases typically have pin couplings that are axially inserted base first into a socket, or that are clamped to by mechanical closures. The straight pin insertion is not always secure, while the clamped to process is time consuming. There is then a need for a high wattage, high temperature lamp base that may be rapidly inserted and securely coupled in place. There is also a need for a high wattage, high temperature lamp base that can be inserted lamp capsule first.

BRIEF SUMMARY OF THE INVENTION

A lamp may be made from a lamp capsule having a press sealed end; and a base formed from an electrically insulating material, having an end of the base with a wall defining a receptacle sized and shaped to receive, along an axis of the base, the press sealed end of the lamp capsule. The base includes a first flange extending from a first side of the base, transverse to the axis. The first flange has a radial side, and has a first electrical contact supported on the first flange and exposed for electrical contact along the radial side. A similarly formed second flange extends from a second side of the base opposite the first side of the base, transverse to the axis; and has a similarly formed radial side including a second electrical contact.

DETAILED DESCRIPTION OF THE INVENTION

Figure 1:
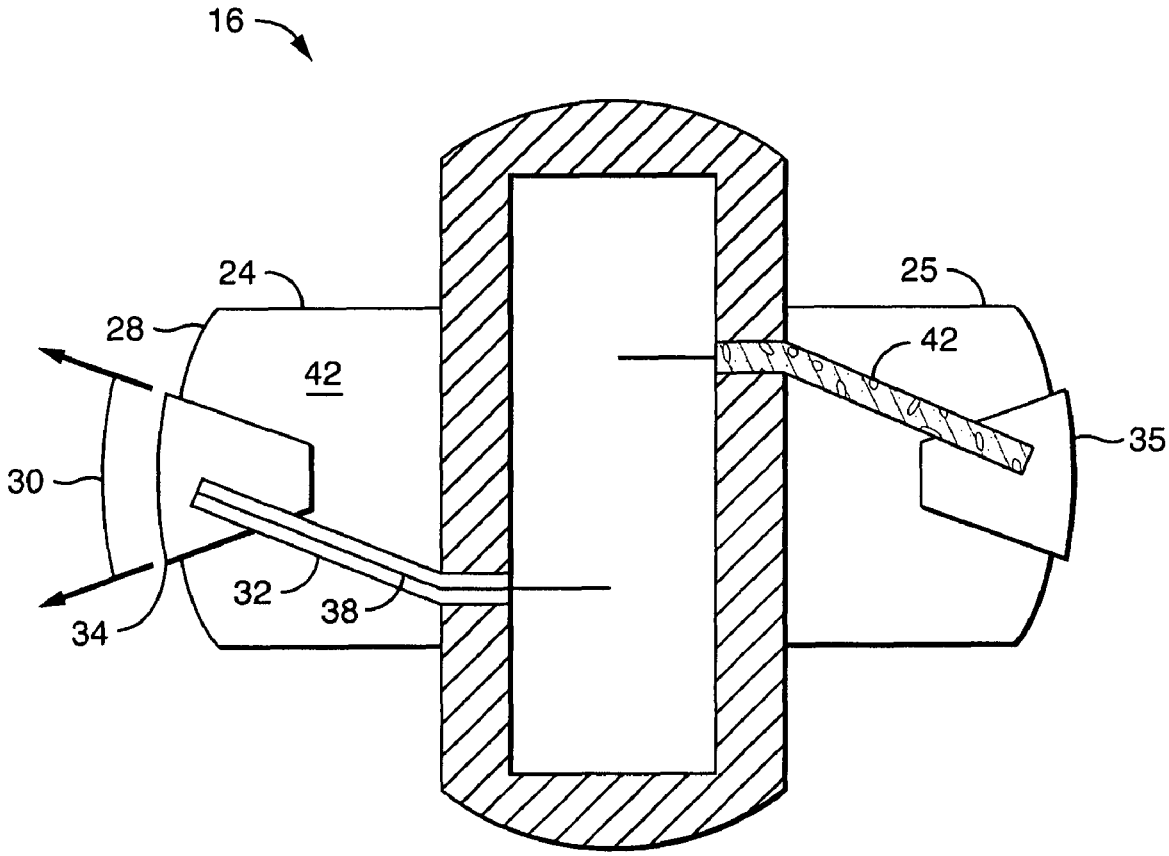
FIG. 1 shows a schematic bottom view in cross section of a lamp base with attached radial arm electrical contacts.
Figure 2:
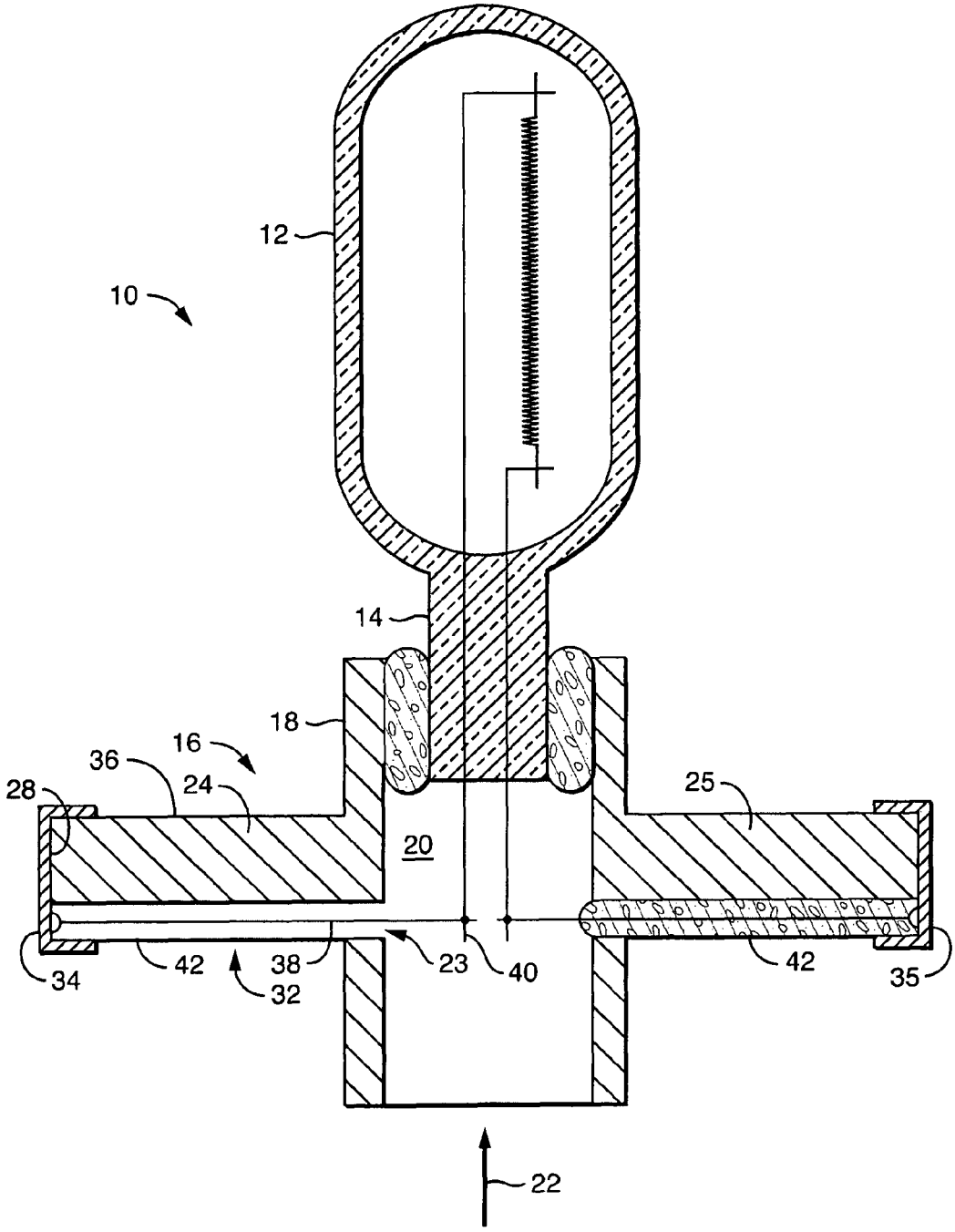
FIG. 2 shows a schematic cross sectional view of a lamp capsule and lamp base with radial arm electrical contacts.

The lamp with radial arm electrical contacts 10 may be made with a lamp capsule 12 having a press sealed end 14. In the preferred embodiment the lamp capsule 12 is a tubular lamp enclosing a multi-segment filament, typical of photo-optical lamps. FIG. 1 shows a schematic bottom view of a lamp base with attached radial arm electrical contacts. FIG. 2 shows a schematic cross sectional view of a lamp capsule and lamp base with radial arm electrical contacts.

The lamp 10 also includes a base 16 formed from an electrically insulating material. The preferred insulating material is a molded ceramic, but could be a high temperature resin or other appropriate insulating material. The base 16 is formed with an end with a wall 18 defining a receptacle 20. The preferred wall 18 stands up in the direction of an axis 22 of the base 16. The wall 18 is sized and shaped to receive, along the axis 22 of the base 16, the press seal 14 of the lamp capsule 12. Since a press seal 14 is usually approximately flat on two opposed sides, the receptacle 20 is conveniently formed as a box with a narrow rectangular opening. The opening is shaped with sufficient width and breadth to receive the press seal 14 in axial insertion. The lamp capsule 12 and base 16 may be cemented together as is known in the art. Formed in the sidewall of the base is a first through passage 23.

The base 16 includes a first flange 24 extending from a first side of the base 16, and adjacent the first through passage 23. The first flange may have form of a radial arm. The first flange 24 extends transverse to the axis 22. The first flange 24 has a radial side 28 that may include a section that is a body of rotation 30 about the base axis 22. Formed in the first flange may be a trench 32 extending from the first through passage 23. The trench 32 extends along the first flange 24 to a first electrical contact 34 supported on the first flange 24 and exposed for electrical contact along the radial side 28 in an appropriately shaped electrical socket.

The base 16 includes a similarly formed second flange 25 extending from a second side of the base 16 opposite the first side of the base 16, and again may have the form of a radial arm. The second flange 25 extends transverse to the axis 22, and having a similarly formed radial side including a second electrical contact 35. A similar second through passage and second trench lead to the second contact 35. The first electrical contact 34 and the second electrical contact 35 are electrically connected to the lamp capsule 12 to provide electrical coupling paths. For example a wire 38 may be coupled from the contact 34, lie in the trench 32 and extend through the through passage 23 to the base interior for electrical coupling to a lamp lead 40. The trench 32 may then be filled with cement 42 to insulate and protect the wire 38 in the trench 32. Alternatively, the wire 38 may extend along the (untrenched) surface of the flange 24.

The first flange 24 may be further formed with a top side 36, and the first electrical contact 34 may be further exposed for electrical contact on the top side 36 of the first flange 24. Similarly, the first flange 24 may include a bottom side 42, and the first electrical contact 34 may be further exposed for electrical contact along the bottom side 42 of the first flange 24. Since the second flange 25 is similar to the first flange 24, the second flange 25 may be formed with a top side or a bottom side and the second electrical contact 35 may be extended for exposure on such top or bottom side. The radial side 28 of the flanges 24, 25 may include a portion of a body of rotation 30 about the base 16 axis 22 to enhance mechanical or electrical twist coupling of the lamp base 16 in a socket. The extended flanges may be latched to or clipped to in appropriately formed matching sockets, thereby enabling rapid and secure lamp insertion. The radial periphery of the base or more specifically of the flanges may be keyed to the socket to help orient the lamp, or define the proper lamp for the socket. The contacts being mounted on the side extending flanges enable a socket to be designed that allows the lamp capsule to be inserted first in the lamp socket.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A lamp comprising:

a lamp capsule having a sealed end and a central longitudinal axis;

a base formed from an electrically insulating material, having an end of the base with a wall defining a receptacle sized and shaped to receive, along an axis of the base, the sealed end of the lamp capsule;

a first flange extending from a first side of the base, and transverse to the axis; the first flange having a first electrical contact exposed for electrical contact, the first electrical contact comprising on an upper surface thereof an upwardly facing first upper exposed contact region and on a lower surface thereof a downwardly facing first lower exposed contact region that is, in an axial direction, in register with the first upper exposed contact region and facing away from the first upper exposed contact region;

a second flange extending from a second side of the base opposite the first side of the base, and extending transverse to the axis; the second flange having a second electrical contact exposed for electrical contact, the second electrical contact comprising on an upper surface thereof an upwardly facing second upper exposed contact region and on a lower surface thereof a downwardly facing second lower exposed contact region that is, in an axial direction, in register with the second upper exposed contact region and facing away from the second upper exposed contact region; and the lamp capsule being irremovably held in the receptacle and being electrically coupled via respective lead wires to the first electrical contact and the second electrical contact, each of the first and second contacts being wider, in a direction extending radially away from the lamp central longitudinal axis, than a lateral width of the respective said lead wire.

2. The lamp in claim 1, wherein the first flange and the second flange are similarly formed.

3. The lamp in claim 1, wherein the first electrical contact and the second electrical contact are similarly formed.

4. The lamp in claim 1, wherein the lamp is a press sealed lamp, and the press seal is held in the base.

5. The lamp in claim 1, wherein the first flange includes a top side, and the electrical contact is further exposed for electrical contact on the top side of the flange.

6. The lamp in claim 1, wherein the first flange includes a bottom side, and the first electrical contact is further exposed for electrical contact on the bottom side of the flange.

7. The lamp in claim 1, wherein at least one of the first flange and the second flange has a radial side, the radial side including a portion of a body of rotation about the axis.

8. A lamp comprising:

a lamp capsule having a press sealed end and a central longitudinal axis;

a base formed from an electrically insulating material, having an end of the base with a wall defining a receptacle sized and shaped to receive, along an axis of the base, the press sealed end of the lamp capsule;

a first flange extending from a first side of the base, and transverse to the axis; the first flange having a first electrical contact exposed for electrical contact, the first electrical contact comprising on an upper surface thereof an upwardly facing first upper exposed contact region and on a lower surface thereof a downwardly facing first lower exposed contact region that is, in an axial direction, in register with the first upper exposed contact region and facing away from the first upper exposed contact region;

a second flange, similarly formed to the first flange, extending from a second side of the base opposite the first side of the base, and extending transverse to the axis; the second flange having a second electrical contact, similarly formed to the first electrical contact, exposed for electrical contact, the second electrical contact comprising on an upper surface thereof an upwardly facing second upper exposed contact region and on a lower surface thereof a downwardly facing second lower exposed contact region that is, in an axial direction, in register with the second upper exposed contact region and facing away from the second upper exposed contact region; and the lamp capsule being irremovably held along the press seal in the receptacle and being electrically coupled via respective lead wires to the first electrical contact and the second electrical contact, the lamp capsule being irremovably held in the receptacle and being electrically coupled via respective lead wires to the first electrical contact and the second electrical contact, each of the first and second contacts being wider, in a direction extending radially away from the lamp central longitudinal axis, than a lateral width of the respective said lead wire.

9. The lamp in claim 1, wherein the first and second electrical contacts are formed separate from and disposed on the respective first and second flanges.

10. The lamp in claim 1, wherein the upwardly facing first and second upper exposed contact regions generally face in a direction of the lamp capsule, and the downwardly facing first and second lower exposed contact regions generally face in a direction away from the lamp capsule.

11. The lamp in claim 1, wherein the downwardly facing first and second lower exposed contact regions are unobstructed by the base.

12. The lamp in claim 11, wherein the upwardly facing first and second upper exposed contact regions are unobstructed by the base.

13. The lamp in claim 1, wherein the first and second flanges are diametrally opposite.

14. The lamp in claim 8, wherein the upwardly facing first and second upper exposed contact regions generally face in a direction of the lamp capsule, and the downwardly facing first and second lower exposed contact regions generally face in a direction away from the lamp capsule, and wherein the downwardly facing first and second lower exposed contact regions are unobstructed by the base.

15. A lamp comprising:

a lamp capsule having a sealed end and a central longitudinal axis;

a base formed from an electrically insulating material, the base having a wall defining a receptacle sized and shaped to receive, along an axis of the base, the sealed end of the lamp capsule;

a first electrical contact extending transverse to the axis, the first electrical contact comprising an upwardly facing first upper exposed contact region and a downwardly facing first lower exposed contact region that is, in an axial direction, in register with the first upper exposed contact region and facing away from the first upper exposed contact region;

a second electrical contact extending transverse to the axis, the second electrical contact comprising an upwardly facing second upper exposed contact region and a downwardly facing second lower exposed contact region that is, in an axial direction, in register with the second upper exposed contact region and facing away from the second upper exposed contact region; and the lamp capsule being irremovably held in the receptacle and being electrically coupled via respective lead wires to the first electrical contact and the second electrical contact, each of the first and second contacts being wider, in a direction extending radially away from the lamp central longitudinal axis, than a lateral width of the respective said lead wire.

16. The lamp in claim 15, wherein a potion of the electrically insulating base material is disposed, in an axial direction, between respective pairs of upper and lower exposed lower exposed contact regions.

17. The lamp in claim 15, wherein first and second flanges are formed on the base of the electrically insulating material, the first and second flanges being located spaced apart around the axis, the first and second electrical contacts being disposed on the respective first and second flanges.

18. The lamp in claim 15, wherein the upwardly facing first and second upper exposed contact regions generally face in a direction of the lamp capsule, and the downwardly facing first and second lower exposed contact regions generally face in a direction away from the lamp capsule.

19. The lamp in claim 16, wherein the downwardly facing first and second lower exposed contact regions are unobstructed by the base.

20. The lamp in claim 19, wherein the upwardly facing first and second upper exposed contact regions are unobstructed by the base.

21. The lamp in claim 1, wherein, at locations most radially distant from the lamp capsule, the first and second electrical contacts along both the upper and lower contact regions extend, in the axial direction, beyond adjacent portions of the lamp.

22. The lamp in claim 8, wherein, at locations most radially distant from the lamp capsule, the first and second electrical contacts along both the upper and lower contact regions extend, in the axial direction, beyond adjacent portions of the lamp.

23. The lamp in claim 15, wherein, at locations most radially distant from the lamp capsule, the first and second electrical contacts along both the upper and lower contact regions extend, in the axial direction, beyond adjacent portions of the lamp.

* * * * *